US005336857A

United States Patent [19]

Yoshida

[11] Patent Number: 5,336,857

[45] Date of Patent: Aug. 9, 1994

[54] ROLLER CONTACT DEVICE

[75] Inventor: Kazuo Yoshida, Hyogo, Japan

[73] Assignee: Mitsubishi Denki Kabushiki Kaisha, Tokyo, Japan

[21] Appl. No.: 995,042

[22] Filed: Dec. 22, 1992

[51] Int. Cl.[5] ..... H01H 1/06; H01H 1/16

[52] U.S. Cl. ..... 200/277; 200/257; 200/258; 200/260

[58] Field of Search ..... 200/277, 277.1, 277.2, 200/257, 258, 240, 432, 455, 531, 536, 561, 245, 246, 247, 250, 252, 260, 261

[56] References Cited

U.S. PATENT DOCUMENTS

| | | | |
|---|---|---|---|
| 3,812,309 | 5/1974 | Ahreno | 200/277 X |
| 3,903,390 | 2/1975 | Cottereau | 200/277 |
| 4,772,766 | 9/1988 | Forzieri | 200/277 X |
| 5,017,744 | 5/1991 | Yoshida | 200/277 |

FOREIGN PATENT DOCUMENTS 3223669 of 1984 Fed. Rep. of Germany .

*Primary Examiner*—Glenn T. Barrett
*Attorney, Agent, or Firm*—Sughrue, Mion, Zinn, Macpeak and Seas

[57] ABSTRACT

To achieve a small-sized roller contact device having an increased capacity of current flow, the front and rear roller contacts 4*a* and 4*b* are arranged such that they face each other with the contact portions 1*a* and 2*a* of the first and second fixed contacts 1 and 2 therebetween to bridge-contact the contact portions 1*a* a and 2*a* of first and second fixed contacts 1 and 2 from the front and rear sides of the portions of the first and second fixed contacts 1 and 2 which are arranged in parallel to each other. The front and rear roller contacts 4*a* and 4*b* are supported by the front and rear roller contact supporting members 5*a* and 5*b*, respectively. The driving member 6 extends between the first and second fixed contacts 1 and 2 and supports the front and rear roller contact supporting members 5*a* and 5*b*. The springs are installed between the front and rear roller contact supporting members 5*a* and 5*b*.

13 Claims, 4 Drawing Sheets

FIG. 7 (b) PRIOR ART

FIG. 7 (c) PRIOR ART

ROLLER CONTACT DEVICE

BACKGROUND OF THE INVENTION

The present invention relates to a roller contact device which includes a roller bridge-contacting two fixed contacts, a so-called bridge type roller contact.

Generally speaking, in roller contact devices which use a bridge type roller contact, an electric current path is formed between a first fixed contact and a second fixed contact via a roller. Since there are no sliding portions in contact with the roller it can rotate freely, electrolytic corrosion at the contact portions does not occur, and the smooth rotation of the roller can always be maintained.

However, when an increase in the capacity of current flow is desired for such a roller contact device, a plurality of roller contacts are arranged in parallel, either in an axial, travelling direction thereof, or in a coaxial combination.

FIG. 7(*a*) is a plan view of a conventional roller contact device as disclosed in Laid-Open Japanese Patent Application No. 62-52405, which consists of two sets of the first fixed contacts 1 and second fixed contacts 2, and roller contacts 3, each of which are arranged in the axial direction of the roller contacts 3 and connected in a parallel manner.

FIG. 7(*b*) is a perspective view of another conventional roller contact device as disclosed in Laid-Open Japanese Patent Application No. 62-52405, wherein two units of roller contact 3 are disposed in parallel in a travelling direction thereof.

FIG. 7(*c*) is a sectional view of another conventional roller contact device as disclosed in Laid-Open Japanese Patent Application No. 62-52405, wherein two units of roller contact 3 are arranged such that their barrels are in the form of coaxial cylinders.

In this way, in conventional roller contact devices, since multiple units of the roller contact 3 are disposed in parallel, either in an axial direction, a travelling direction, or in a coaxial combination, the two roller contacts, which are connected in parallel thus doubling the capacity of current flow.

As described in the foregoing, in conventional roller contact devices, since two units of the roller contact 3 are disposed in parallel in an axial direction thereof, the size of the roller contact device is doubled in terms of the axial direction; since two units of the roller contact 3 are disposed in parallel in a travelling direction thereof, the size of the roller contact device is doubled in terms of the travelling direction, which is disadvantageous to ensure insulation distance between adjacent fixed contacts; or, since two units of the roller contact 3 are in coaxial combination, the size of the device in an axial direction needs to be increased only slightly, but the diameter must be increased considerably, resulting in a large roller contact device in both axial and travelling directions of the roller contact. In either case, as two units of the roller contact 3 are disposed on the same side with respect to the first fixed contact 1 and the second fixed contact 2, contact reaction force is applied directly to fixed contact supporting members for the first fixed contact 1 and the second fixed contact 2 and a roller contact driving member as pressure. Therefore, the fixed contact supporting members and the roller contact driving member need to be structured such that they can withstand this pressure. In addition, as the number of roller contacts increases, the roller contact device becomes bulkier.

SUMMARY OF THE INVENTION

The present invention is intended to solve the above problems, and it is an object of the invention to provide a small-sized roller contact device which can minimize an increase in size caused by the increase in the number of roller contacts, prevent contact reaction force from affecting the fixed contact supporting members and the roller contact driving member, and which has an increased capacity of current flow.

To achieve the above object, a roller contact device according to the first invention comprises:

first and second fixed contacts which are disposed in parallel;

at least one pair of roller contacts consisting of front and rear roller contacts which face each other with the first and second fixed contacts therebetween so that they can bridge-contact the first and second fixed contacts from the front and rear sides thereof;

front and rear roller contact supporting members for supporting the front and rear roller contacts, respectively;

a driving member disposed between the first and second fixed contacts for supporting the front and rear roller contact supporting members to move them in parallel to the first and second fixed contacts; and springs for pressing the front and rear roller contacts against the first and second fixed contacts.

A roller contact device according to the second invention comprises:

first and second fixed contacts disposed in parallel to each other;

at least one pair of roller contacts consisting of front and rear roller contacts which face each other with the first and second fixed contacts therebetween so that they can bridge-contact the first and second fixed contacts from the front and rear sides thereof;

front and rear roller contact supporting members for supporting the front and rear roller contacts, respectively;

a front support fork for supporting the front roller contact supporting member;

a rear support fork disposed between the first and second fixed contacts for supporting the rear roller contact supporting member;

a driving member for supporting the front and rear support forks to move them in parallel to the first and second fixed contacts; and springs for pressing the front and rear roller contacts against the first and second fixed contacts.

In the present invention, since the front and rear roller contacts face each other with the first and second fixed contacts therebetween so that they can bridge-contact the first and second fixed contacts from the front and rear sides thereof, the size of the roller contact device does not increase in terms of the axial direction or travelling direction of the front and rear roller contacts, thus eliminating the disadvantage which occurs when trying to secure insulation distance between the adjacent first and second fixed contacts. Although the size of the roller contact device increases in the front and rear directions of the front and rear fixed contacts, insulation distance between the adjacent first and second fixed contacts does not need to be taken into consideration, thus making it possible to minimize an increase in the size of the device.

Furthermore, the contact pressures of the springs applied to the front and rear sides of the first and second fixed contacts through the front and rear roller contacts are the same in force and opposite in direction, and accordingly, substantial external force applied to the first and second fixed contacts becomes zero. Consequently, the strength of the first and second fixed contact supporting members does not need to be increased, whereby an increase in the size of the device can be eliminated.

The above and other objects, features and advantages of the invention will become more apparent from the following description when taken in conjunction with the accompanying drawings.

DESCRIPTION OF THE PREFERRED EMBODIMENT

Preferred embodiments of the present invention will be described with reference to the accompanying drawings.

Embodiment 1

Figure 1:
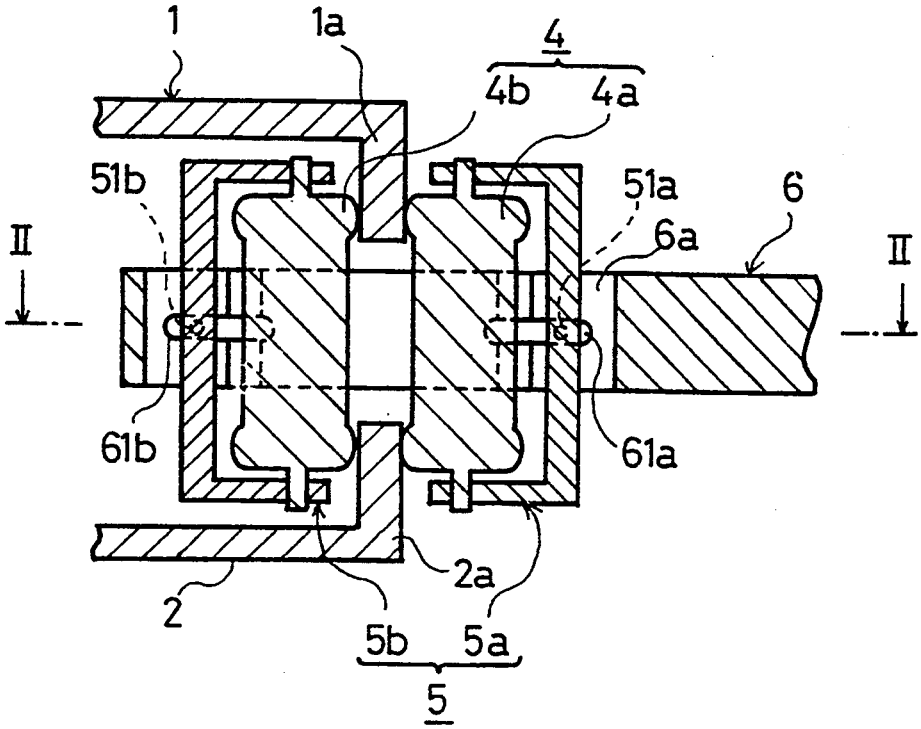
FIG. 1 is a sectional side view of a roller contact device according to a first embodiment of the invention.
Figure 2:
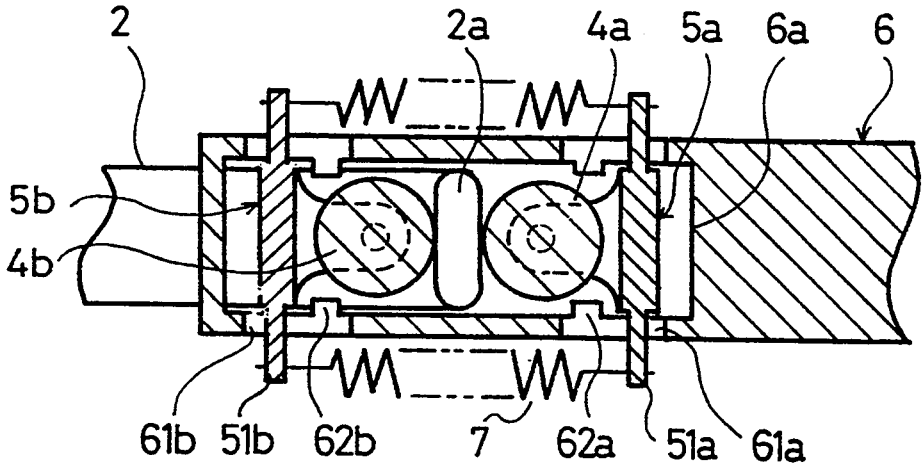
FIG. 2 is a sectional view taken on line II—II of FIG. 1.
Figure 7A:
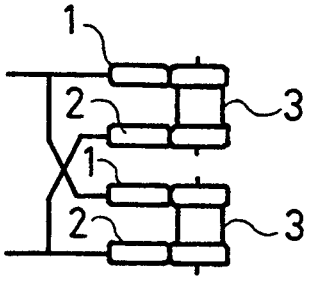
FIG. 7(a) PRIOR ART
FIG. 7(*a*), (*b*) and (*c*) are plan, perspective and sectional views of conventional roller contact devices, respectively.
Figure 7A:
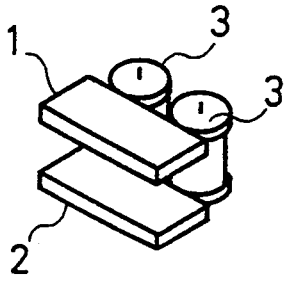
FIG. 7(a) PRIOR ART
Figure 7A:
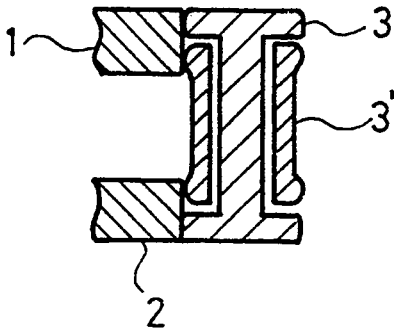
FIG. 7(a) PRIOR ART

FIG. 1 is a sectional side view of a roller contact device according to an embodiment of the invention, and FIG. 2 is a sectional view taken on line II—II of FIG. 1. In these figures, the reference symbols shown represent the same or corresponding elements as those symbols of the conventional roller contact devices shown in FIG. 7(*a*), (*b*) and (*c*), and their descriptions will be omitted.

In FIG. 1 and FIG. 2, reference symbols 1*a* and 2*a* represent contact portions located at the ends of the L-shaped first and second fixed contacts 1 and 2. These first and second fixed contacts 1 and 2 are disposed in parallel so that the end surfaces of the contact portions 1*a* and 2*a* thereof face each other.

Reference numeral 4 represents a pair of roller contacts consisting of a front roller contact 4*a* and a rear roller contact 4*b* which are disposed on the front and rear sides of the first and second fixed contacts 1 and 2, and face each other with the contact portions 1*a* and 2*a* therebetween. Numeral 5 represents a pair of roller contact supporting members which consist of a front roller contact supporting member 5*a* and a rear roller contact supporting member 5*b* for supporting both top and bottom ends of the front and rear roller contacts 4*a* and 4*b*, respectively, so that the front and rear roller contacts can rotate freely. The front and rear roller contact supporting members 5*a* and 5*b* are provided with central fulcrum pins 51*a* and 51*b*, respectively, and have a substantially U-shaped section.

Reference numeral 6 represents a driving member which extends from an unshown driving source disposed in the front (right side of FIG. 1) of the first and second fixed contacts 1 and 2, and which lies between the first and second fixed contacts 1 and 2. The driving member 6 is structured such that it moves in parallel to the first and second fixed contacts 1 and 2 (in a direction perpendicular to the surface of the sheet on which FIG. 1 is drawn). The extended portion of the driving member 6 has an opening 6*a* provided with two pairs of small elongated holes 61*a* and 61*b* on opposing side walls thereof. The central fulcrum pins 51*a* and 51*b* are loosely engaged with the elongated holes 61*a* and 61*b*, respectively, so that the roller contacts 4 and the roller contact supporting members 5 are supported within the opening 6*a*. Furthermore, the driving member 6 is provided with stoppers 62*a* and 62*b* to prevent the front and rear roller contact supporting members 5*a* and 5*b* from coming too close to each other.

Reference numeral 7 represents springs (tension springs) stretched between the central fulcrum pins 51*a* and 51*b* of the front and rear roller contact supporting members 5*a* and 5*b* loosely engaged with the elongated holes 61*a* and 61*b*. Due to the installation of the springs 7, there is always mutual attraction between the front and rear roller contact supporting members 5*a* and 5*b*, that is, between the front and rear roller contacts 4*a* and 4*b* supported by these members.

Here, the stoppers 62*a* and 62*b* are located such that respective predetermined gaps remain between the front roller contact supporting member 5*a* and the front roller contact 4*a*, and between the rear roller contact supporting member 5*b* and the rear roller contact 4*b*, when the front and rear roller contacts 4*a* and 4*b* contact the contact portions 1*a* and 2*a* of the first and second fixed contacts 1 and 2 at the front and rear sides of the portions, and such that the front and rear roller contacts 4*a* and 4*b* are kept in appropriate proximity to the contact portions 1*a* and 2*a* when the front and rear roller contacts 4*a* and 4*b* move away from the contact portions 1*a* and 2*a* so that the front and rear roller contacts 5*a* and 5*b* can easily be re-installed on the contact portions 1*a* and 2*a*.

Meanwhile, the relative outer ends of the elongated holes 61*a* and 61*b* are located such that respective predetermined gaps remain between the front roller contact 4*a* and the central fulcrum pin 51*a* and between the rear roller contact 4*b* and the central fulcrum pin 51*b* when the front and rear roller contacts 4*a* and 4*b* contact the contact portions 1*a* and 2*a* of the first and second fixed contacts 1 and 2 at both the front and rear sides of the portions. Furthermore, the relative inner ends of the elongated holes 61*a* and 61*b* are located such that respective predetermined gaps remain between the front roller contact 4*a* and the central fulcrum pin 51*a* and between the rear roller contact 4*b* and the central fulcrum pin 51*b* when the front and rear roller contacts 4*a* and 4*b* move away from the contact portions 1*a* and 2 of the first and second fixed contacts 1 and 2, and the front and rear roller contact supporting members 5*a* and 5*b* contact the stoppers 62 and 62*b* provided on the driving member 6.

The operation of the roller contact device of Embodiment 1 will be described hereafter.

To allow an electric current to flow through the roller contact device, the driving member 6 is moved in a direction perpendicular to the surface of the sheet on which FIG. 1 is drawn by activating the driving source, and stopped when it reaches a position immediately above and below the first and second fixed contacts 1 and 2 so that the front and rear roller contacts 4*a* and 4*b* sandwich the contact portions 1*a* and 2*a* of the first and second fixed contacts 1 and 2 at the front and rear sides of the portions to bridge-contact the portions.

At this time, since respective predetermined gaps are secured between the central fulcrum pin 51*a* of the front roller contact supporting member 5*a* and the elongated hole 61*a* of the driving member 6 and between the central fulcrum pin 51*a* of the front roller contact supporting member 5*a* and the stopper 62*a* of the driving member 6, between the central fulcrum pin 51*b* and the hole 61*b*, and between the central fulcrum pin 51*b* and the stopper 62*b*, these portions are not able to carry a load. Therefore, the force of the springs 7 is equally distributed and applied to points of contact between the front and rear roller contacts 4*a* and 4*b* and the contact portions 1*a* and 2*a* of the first and second fixed contacts 1 and 2 through the central fulcrum pins 51*a* and 51*b*, the front and rear roller contact supporting members 5*a* and 5*b*, and the front and rear roller contacts 4*a* and 4*b*. Consequently, an electric current flows in a passage way from the first fixed contact 1 to the front and rear roller contacts 4*a* and 4*b* and the second fixed contact 2 through these points of contact applied by this contact load (contact pressure).

To stop the current from flowing through the roller contact device, the driving member 6 is moved in a direction opposite to the above-mentioned direction, or farther in the same direction, to release the front and rear roller contacts 4*a* and 4*b* from the contact portions 1*a* and 2*a* of the first and second fixed contacts 1 and 2.

In this way, according to the above-mentioned Embodiment 1, the front and rear roller contacts 4*a* and 4*b* are installed on the front and rear sides of the contact portions 1*a* and 2*a* of the first and second fixed contacts 1 and 2 so that they face each other with the contact portions 1*a* and 2*a* therebetween, thus providing the following effects.

Compared with the conventional roller contact device in which roller contacts 3 are arranged in parallel in front of the first and second fixed contacts 1 and 2, the increase in the size of the roller contact device of the present invention is halved in the direction of adjacent fixed contacts, it is easy to secure an insulation distance between adjacent fixed contacts, and it is possible to minimize an increase in the size of the entire device. (At this time, the size of the device is increased by the diameter of the roller contact in the front and rear directions of the fixed contacts, but a substantial increase in the size of the device can be minimized because it is not necessary to secure an insulation distance between adjacent fixed contacts.)

Furthermore, when a current flows through the device, and inducted electromagnetic force is generated between a pair of the front and rear roller contacts 4*a* and 4*b* by mutual attraction caused by a current of the same direction. This inducted electromagnetic force enhances contact pressure. Since the force is in proportion to the square of the current, contact force increases as a current becomes larger. As a result, a roller contact highly resistant to an electric surge such as a short-circuit current can be achieved.

External force applied to the first and second fixed contacts 1 and 2 is the only contact pressure applied to the front and rear sides of the contact portions 1*a* and 2*a* thereof. However, since these contact pressures are the same in force and opposite in direction, they are offset by each other to become substantially zero. Therefore, there is no need to increase the strength of the supporting members for the first and second fixed contacts 1 and 2, thus controlling the increase in the size of the device.

Furthermore, since the springs 7 are stretched between a pair of roller contact supporting members 5 in the above-mentioned Embodiment 1, the following effect can be achieved.

When a current flows through the device, the force of the spring is distributed and applied to points of contact between the roller contacts 4 and the first and second fixed contacts 1 and 2 through a pair of roller contact supporting members 5. Therefore, the driving member 6 is not affected by the force. When a current does not flow through the device, the force of the spring is applied to the stoppers 62*a* and 62*b* provided on the driving member 6. However, since the distributed forces are the same in force and opposite in direction, they are offset by each other. As a result, substantial external force applied to the driving member 6 becomes equal to zero. Therefore, there is no need to increase the strength of the driving member 6, thus controlling the increase in the size of the device.

Embodiment 2

Figure 3:
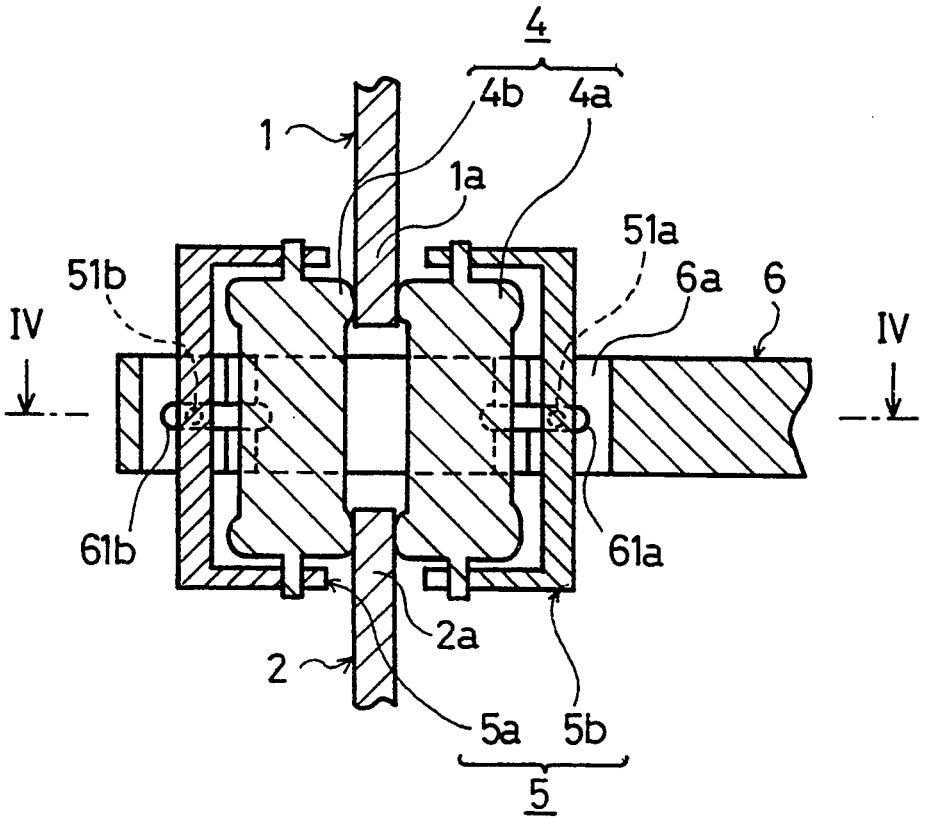
FIG. 3 is a sectional side view of a roller contact device according to another embodiment of the invention.
Figure 4:
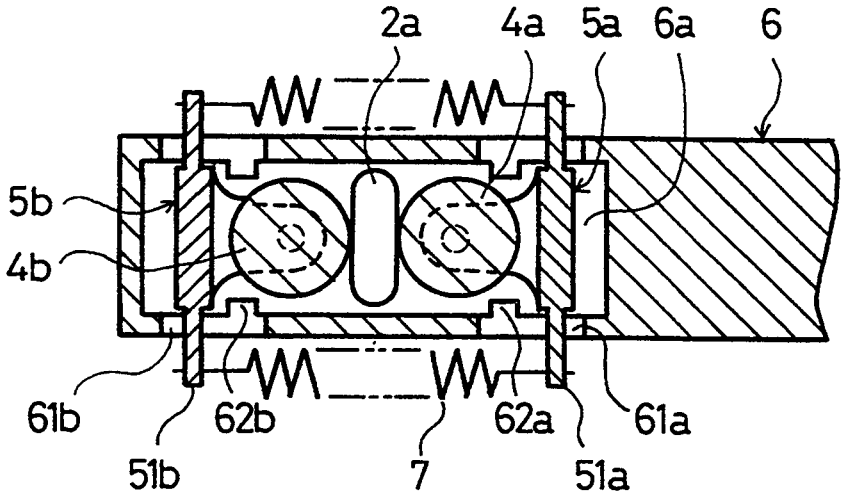
FIG. 4 is a sectional view taken on line IV—IV of FIG. 3.

In the above-mentioned Embodiment 1, L-shaped first and second fixed contacts 1 and 2 are arranged in parallel to each other so that the end surfaces of the contact portions 1*a* and 2*a* thereof face each other, and a pair of roller contacts 4 consisting of the front and rear roller contacts 4*a* and 4*b* are installed on the front and rear sides of the contact portions 1*a* and 2*a* of the first and second fixed contacts 1 and 2, respectively, in such a way that they face each other with the contact portions 1*a* and 2*a* therebetween. In contrast, in Embodiment 2, as shown in FIG. 3 and FIG. 4, I-shaped first and second fixed contacts 1 and 2 extending in an axial direction thereof are arranged in parallel to each other so that the end surfaces of the contact portions 1*a* and 2*a* located at the ends thereof face each other, and a pair of roller contacts 4 consisting of front and rear roller contacts 4*a* and 4*b* are installed on the front and rear sides of the contact portions 1*a* and 2*a* of the first and second fixed contacts 1 and 2, respectively, so that they face each other with the contact portions 1*a* and 2*a* therebetween. The same effect as that of Embodiment 1 can be achieved.

Embodiment 3

Figure 5:
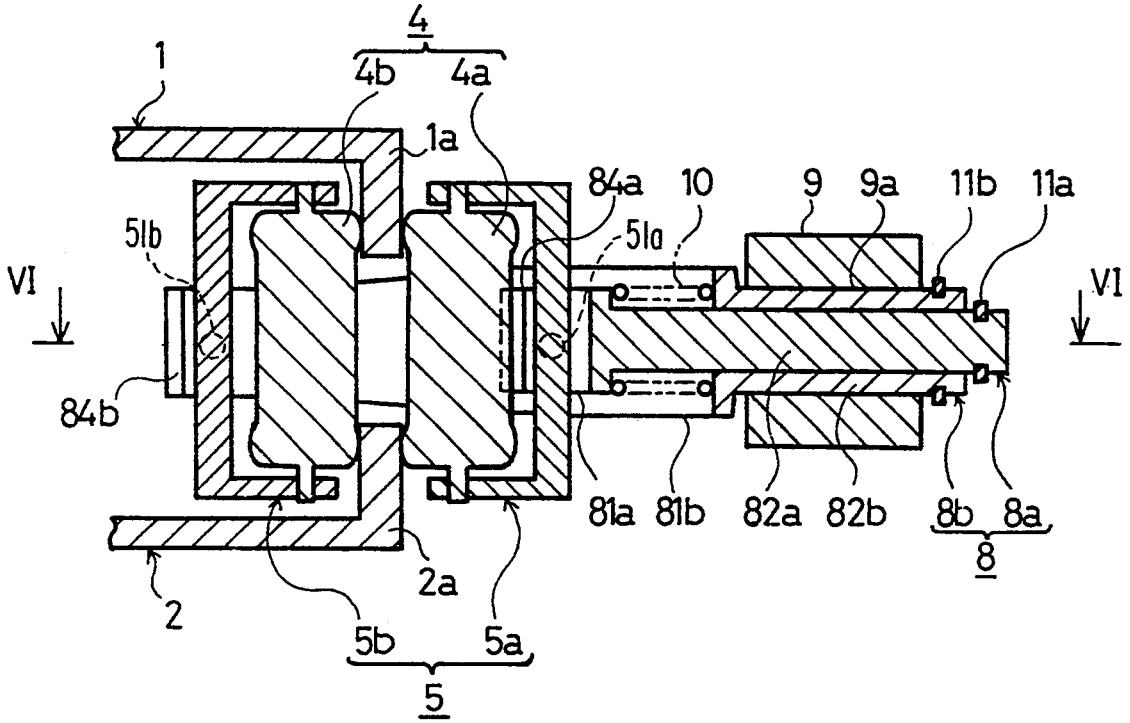
FIG. 5 is a sectional side view of a roller contact device according to a further embodiment of the invention.
Figure 6:
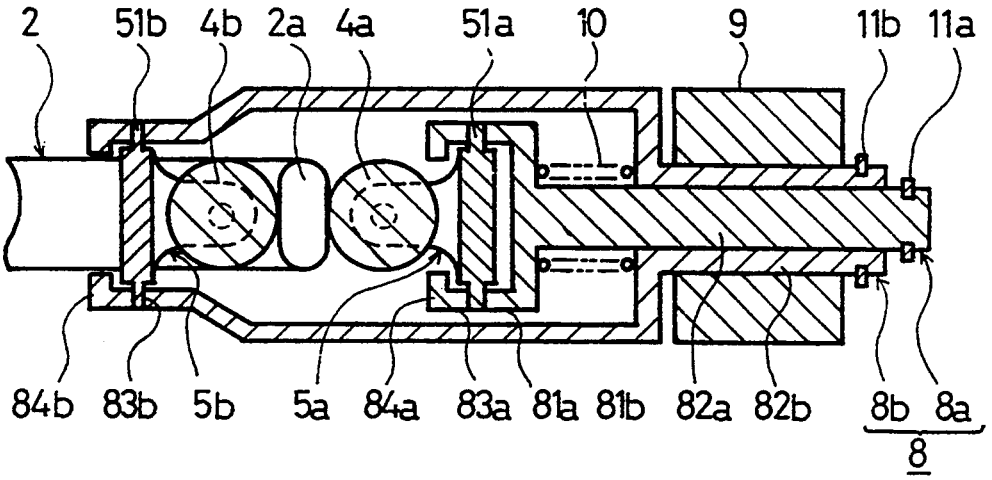
FIG. 6 is a sectional view taken on line VI—VI line of FIG. 5.

FIG. 5 is a sectional side view of a roller contact device according to another embodiment of the invention, and FIG. 6 is a sectional view taken on line VI—VI of FIG. 5.

In these figures, reference numeral 8 represents a pair of support forks consisting of a front support fork 8*a* and a rear support fork 8*b*. The rear support fork 8*b* is installed between the first and second fixed contacts 1 and 2. Numeral 9 represents a driving member extending from an unshown driving source, and 10 a spring (compression spring) stretched between the front and rear support forks 8*a* and 8*b*.

The front and rear support forks 8*a* and 8*b* comprise support portions 81*a* and 81*b* and angular shaft portions 82*a* and 82*b*, respectively. A pair of support forks 8 consist of the front support fork 8*a* disposed on the inner side thereof and the rear support fork 8*b* on the outer side thereof so that they do not interfere with each other. The angular shaft portion 82*a* of the front support fork 8*a* is loosely engaged with a shaft center hole provided in the angular shaft portion 82*b* of the rear support fork 8*b* so that the support forks form a double coaxial structure and can move independently. Furthermore, the angular portion 82*b* of the rear support fork 8*b* is loosely engaged with an angular hole 9*a* provided in the driving member 9 so that the front and rear support forks are movably supported by the driving member 9.

On the supporting portions 81*a* and 81*b* of the front and rear support forks 8*a* and 8*b*, holes 83*a* and 83*b* are provided, respectively, and are loosely engaged with the central fulcrum pins 51*a* and 51*b* of the front and rear roller contact supporting members 5*a* and 5*b* to support them.

At the ends of the support portions 81*a* and 81*b*, rotation stoppers 84*a* and 84*b* are provided to prevent the front and rear roller contact supporting members 5*a* and 5*b* for supporting the front and rear roller contacts 4*a* and 4*b* from inclining more than necessary when the front and rear roller contacts 4*a* and 4*b* move away from the first and second fixed contacts 1 and 2, respectively, (in order to facilitate the re-installation of the roller contacts 4).

At the end of the angular shaft portion 82*a*, a stopper 11*a* is provided to prevent the front support fork 8*a* from projecting toward the side of the first and second fixed contacts 1 and 2 more than necessary, and at the end of the angular shaft portion 82*b*, a stopper 11*b* is also provided to prevent the rear support fork 8*b* from projecting from the driving member 9 more than necessary.

Relative positions for installing the rear support fork 8*b* and the driving member 9 and a position for installing the stopper 11*b* are set such that respective predetermined gaps remain between the stopper 11*b* and the driving member 9 and between the support portion 81*b* and the driving member 9 when the front and rear roller contacts 4*a* and 4*b* are in contact with the contact portions 1*a* and 2*a* of the first and second fixed contacts 1 and 2. Relative positions for installing the front support fork 8*a* and the rear support fork 8*b* and a position for installing the stopper 11*a* are set such that the spring 10 does not bring the front and rear roller contacts 4*a* and 4*b* into close contact and that a predetermined gap remains between the stopper 11*a* and the angular shaft end surface of the rear support fork 8*b* when the front and rear roller contacts 4*a* and 4*b* are in contact with the contact portions 1*a* and 2*a* of the first and second fixed contacts 1 and 2. Moreover, the position of the stopper 11*a* is set such that it can keep the front and rear roller contacts 4*a* and 4*b* in appropriate proximity to the contact portions 1*a* and 2*a* when they move away from the contact portions 1*a* and 2*a* so that they can be easily reinstalled on the front and rear roller contacts 4*a* and 4*b*.

There is always mutual attraction between the front and rear roller contact supporting members 5*a* and 5*b* supported by a pair of support forks 8 and between the front and rear roller contacts 4*a* and 4*b* due to the spring 10 stretched between the front and rear support forks 8*a* and 8*b*.

The operation of the above-mentioned Embodiment 3 will be described hereafter.

To allow an electric current to flow through the roller contact device, the driving member 9 is moved in a direction perpendicular to the surface of the sheet on which FIG. 5 is drawn by activating the driving source, and stopped when it reaches a position immediately above and below the first and second fixed contacts 1 and 2 so that the front and rear roller contacts 4*a* and 4*b* sandwich the contact portions 1*a* and 2*a* of the fixed contacts 1 and 2 at the front and rear sides of them to bridge-contact the portions.

At this time, since respective predetermined gaps are established between the support portion 81*b* of the rear support fork 8*b* and the driving member 9, between the stopper 11*b* and the driving member 9, between the stopper 11*a* and the angular shaft end surface of the rear support fork 8*b*, between the rotation stopper 84*a* of the support portion 81*a* and the front roller contact supporting member 5*a*, and between the rotation stopper 84*b* of the support portion 81*b* and the rear roller contact supporting member 5*b*, these portions are not able to carry a load. Therefore, the force of the spring 10 is evenly distributed and applied to points of contact between front and rear roller contacts 4*a* and 4*b* and the contact portions 1*a* and 2*a* of the first and second fixed contacts 1 and 2 through the front and rear support forks 8*a* and 8*b*, the central fulcrum pins 51*a* and 51*b*, the front and front and rear roller contacts 4*a* and 4*b*. As a result, a current flows from the first fixed contact 1 to the front and rear roller contacts 4*a* and 4*b* and the second fixed contact 2 through these points of contact applied by this contact load (contact pressure).

To stop a current from flowing through the device, the driving member 9 is moved in a direction opposite to the above-mentioned direction, or farther in the same direction to release the front and rear roller contacts 4*a* and 4*b* from the contact portions 1*a* and 2*a* of the first and second fixed contacts 1 and 2.

In this way, according to the above Embodiment 3, since the front and rear roller contacts 4*a* and 4*b* are installed on the front and rear sides of the contact portions 1*a* and 2*a* of the first and second fixed contacts 1 and 2, respectively, so that they face each other with the contact portions 1*a* and 2*a* of the first and second fixed contacts 1 and 2 therebetween, and the spring 10 is compressed between a pair of support forks 8 for supporting a pair of roller contact supporting members 5, the same effect as the aforementioned Embodiment 1 can be obtained. In addition, the embodiment has the effect of maintaining mutual attraction between the front and rear roller contact supporting members 5*a* and 5*b* and between the front and rear roller contacts 4*a* and 4*b* even if the spring 10 is broken.

The first and second fixed contacts 1 and 2 are L-shaped as in Embodiment 1, but may have an I shape as in Embodiment 2.

Embodiment 4

In the above-mentioned Embodiment 3, the shaft portions 82*a* and 82*b* of a pair of support forks 8 which form a coaxial double structure are angular. In Embodiment 4, the shaft portions of the support forks 8 are circular, and a sliding key for preventing the mutual rotation of the front and rear support forks 8*a* and 8*b*, and the rotation of the rear support fork 8*b* against the driving member 9 is provided to achieve the same effect.

In each of the above embodiments, a pair of roller contacts 4 are provided, but the present invention is not restricted by these embodiments. The number of roller contacts may be two pairs or more, and the number of roller contact supporting members 5 and support forks 8 increase accordingly. The effect achieved when there are multiple pairs of roller contacts is the same as when there is only one pair.

As described in the foregoing, according to the present invention, the front and rear roller contacts face each other with the first and second fixed contacts therebetween so that they can bridge-contact the first and second fixed contacts from the front and rear sides of the contact portions of the first and second fixed contacts. Therefore, an increase in the size of the device caused by increasing the number of roller contacts can be minimized, and the fixed contacts and the driving member can substantially be free from contact pressure. Thus a small-sized roller contact device having an increased capacity of current flow can be obtained.

What is claimed is:

1. A roller contact device, comprising:

a) first and second fixed electrical contacts (1,2) arranged in parallel to each other;

b) at least one pair of electrically conductive roller contacts (4*a*,4*b*) comprising front and rear roller contacts disposed facing each other with said first and second fixed contacts therebetween so that they can bridge-contact said first and second fixed contacts from front and rear sides thereof;

c) front and rear roller contact support members (5*a*,5*b*) for individually rotatably supporting said front and rear roller contacts, respectively;

d) means provided between said first and second fixed contacts for pivotally mounting said front and rear roller contact support members in parallel to said first and second fixed contacts, via respective first and second centrally disposed fulcrum pins (51*a*,51*b*); and spring means for pressing said front and rear roller contacts against said first and second fixed contacts, e) wherein the rotatable mounting of the roller contacts and the pivotal mounting of the support members enables the roller contacts to equalize contact forces thereof against the fixed contacts.

2. The roller contact device according to claim 1, wherein said spring means stretched between said front and rear roller contact support members.

3. The roller contact device according to claim 2, wherein said spring means comprise tension springs.

4. The roller contact device according to claim 1, wherein said first and second fixed contacts are L-shaped, and are arranged in parallel to each other so that end surfaces of contact portions located at ends thereof face each other.

5. The roller contact device according to claim 1, wherein said first and second fixed contacts are I-shaped, and are arranged in parallel to each other so that end surfaces of contact portions located at ends thereof face each other.

6. The roller contact device according to claim 1, wherein said front and rear roller contact supporting members have a substantially U-shaped section, support top and bottom ends of said front and rear roller contacts so that they can rotate freely, and are provided with central fulcrum pins; and an extension portion of said driving member is provided with an opening having two pair of small elongated holes on the facing side walls thereof so that said central fulcrum pins of said front and rear roller contact supporting members are loosely engaged with these respective holes to support and maintain said roller contacts and said roller contact supporting members within said opening, and stoppers for preventing said front and rear roller contact supporting members from getting too close to each other.

7. A roller contact device, comprising:

a) first and second fixed electrical contacts (1,2) arranged in parallel to each other;

b) at least one pair of electrically conductive roller contacts (4*a*,4*b*) comprising front and rear roller contacts disposed facing each other with said first and second fixed contacts therebetween so that they can bridge-contact said first and second fixed contacts from front and rear sides thereof;

c) front and rear roller contact support members (5*a*,5*b*) for individually rotatably mounting said front and rear roller contacts, respectively, d) a front support fork (8*a*) for pivotally mounting said front roller contact support member via first centrally disposed fulcrum pins (51*a*);

e) a rear support fork (8*b*) disposed between said first and second fixed contacts for pivotally mounting said rear roller contact support member via second centrally disposed fulcrum pins (51*b*);

f) a driving member (9) for supporting said rear and front support forks and moving them in parallel to said first and second fixed contacts; and g) spring means for pressing said front and rear roller contacts against said first and second fixed contacts, h) wherein the rotatable mounting of the roller contacts and the pivotal mounting of the support members enables the roller contacts to equalize contact forces thereof against the fixed contacts.

8. The roller contact device according to claim 7, wherein said spring means is compressed between said front and rear support forks.

9. The roller contact device according to claim 8, wherein said spring means comprises a single compression spring.

10. The roller contact device according to claim 7, wherein said first and second fixed contacts are L-shaped, and are arranged in parallel to each other so that end surfaces of contact portions located at ends thereof face each other.

11. The roller contact device according to claim 7, wherein said first and second fixed contacts are I-shaped, and are arranged in parallel to each other so that end surfaces of contact portions thereof located at ends thereof face each other.

12. The roller contact device according to claim 7, wherein said front and rear support forks comprise support portions (81*a*,81*b*) and angular shaft portions (82*a*,82*b*);

said front support fork is disposed inside of said rear support fork so that they do not interfere with each other;

a shaft center hole provided on the angular shaft portion of said rear support fork is loosely engaged with the angular shaft portion of said front support fork so that said front and rear support forks form a double coaxial structure and can move independently; and the angular shaft portion of said rear support fork is loosely engaged with an angular hole provided on said driving member so that said front and rear support forks are movably supported by said driving member.

13. The roller contact device according to claim 12, wherein a stopper for preventing said front support fork from projecting toward a side of said first and second fixed contacts more than necessary is provided at an end of the angular shaft portion of said front support fork, and a stopper for preventing said rear support fork from projecting from said driving member more than necessary is provided at the end of the angular shaft portion of said rear support fork.

* * * * *